US009388518B2

(12) United States Patent
Kühl

(10) Patent No.: US 9,388,518 B2
(45) Date of Patent: Jul. 12, 2016

(54) METHOD AND DEVICE FOR STRENGTHENING A CONTINUOUSLY FED MATERIAL WEB

(75) Inventor: Norbert Kühl, Ungenach (AT)

(73) Assignee: Hi Tech Textile Holding GmbH, Leonding (AT)

( * ) Notice: Subject to any disclaimer, the term of this patent is extended or adjusted under 35 U.S.C. 154(b) by 397 days.

(21) Appl. No.: 13/984,103

(22) PCT Filed: Feb. 8, 2012

(86) PCT No.: PCT/EP2012/052125

§ 371 (c)(1),
(2), (4) Date: Sep. 18, 2013

(87) PCT Pub. No.: WO2012/107486

PCT Pub. Date: Aug. 16, 2012

(65) Prior Publication Data

US 2014/0310928 A1 Oct. 23, 2014

(30) Foreign Application Priority Data

Feb. 8, 2011 (DE) ..... 10 2011 010 516

(51) Int. Cl.
*D04H 1/46* (2012.01)
*D04H 18/02* (2012.01)

(52) U.S. Cl.
CPC . *D04H 1/46* (2013.01); *D04H 18/02* (2013.01)

(58) Field of Classification Search
CPC ..... D04H 1/46; D04H 18/00; D04H 18/02; D04H 3/102; D04H 3/105; D04H 5/02; D04H 1/44; D04H 1/485; D04H 1/54; D04H 18/04; D04H 3/08; D04H 3/11; D04H 3/12; D04H 3/14; D04H 5/04; D04H 5/06; D06H 3/00; D06H 3/08; D06H 2201/00
USPC ..... 28/107, 111, 113, 114, 115, 103, 102, 28/104, 116, 165, 18.6, 70; 156/148
See application file for complete search history.

(56) References Cited

U.S. PATENT DOCUMENTS 2,992,626 A * 7/1961 Kabelitz ..... D06B 23/26 118/122
3,688,356 A * 9/1972 Scowcroft ..... D02G 1/125 28/251
4,891,870 A 1/1990 Mueller
4,967,222 A * 10/1990 Nitsch ..... G03D 3/132 226/108

(Continued)

FOREIGN PATENT DOCUMENTS

CN 1 494 617 A 5/2004
CN 1 513 071 A 7/2004

(Continued)

*Primary Examiner* — Amy Vanatta
(74) *Attorney, Agent, or Firm* — McGlew and Tuttle, P.C.

(57) ABSTRACT

A method and device are provided for strengthening, in particular needling, a continuously fed material web (21), wherein the material web is strengthened in a strengthening zone and is drawn out of the strengthening zone by a drawing apparatus (24). At least one parameter, in particular the material speed, of the strengthened material web (21) is detected in a guiding zone arranged downstream of the fastening zone and before the drawing apparatus (24) by a measuring apparatus (22), preferably without contact, and is optionally used to control the strengthening apparatus.

18 Claims, 5 Drawing Sheets

(56) References Cited

U.S. PATENT DOCUMENTS

| | | | | | |
|---|---|---|---|---|---|
| 5,257,712 | A * | 11/1993 | Minichshofer | D04H 18/00 | 226/108 |
| 5,349,728 | A * | 9/1994 | Murakami | D04H 18/00 | 28/107 |
| 5,909,883 | A | 6/1999 | Jourde et al. | | |
| 6,360,412 | B1 * | 3/2002 | Duval | D04H 18/02 | 28/107 |
| 8,512,607 | B2 * | 8/2013 | Pedoja | D04H 1/4258 | 264/103 |
| 2002/0133923 | A1 * | 9/2002 | Duval | D04H 18/00 | 28/107 |
| 2004/0118892 | A1 * | 6/2004 | Weber | A61F 13/15772 | 226/44 |

FOREIGN PATENT DOCUMENTS

| | | | |
|---|---|---|---|
| CN | 1 891 883 | A | 1/2007 |
| CN | 2009 71406 | Y | 11/2007 |
| DE | 100 47 223 | A1 | 5/2001 |
| DE | 103 46 473 | A1 | 5/2005 |
| EP | 08 92 102 | A2 | 1/1999 |
| FR | 2877019 | A1 * | 4/2006 |
| GB | 1 449 641 | A | 9/1976 |
| TW | 239 173 | B | 1/1995 |
| WO | 02/070807 | A1 | 9/2002 |
| WO | 2008/151961 | A1 | 12/2008 |

* cited by examiner

METHOD AND DEVICE FOR STRENGTHENING A CONTINUOUSLY FED MATERIAL WEB

CROSS REFERENCE TO RELATED APPLICATIONS

This application is a United States National Phase Application of International Application PCT/EP2012/052125 and claims the benefit of priority under 35 U.S.C. §119 of German Patent Application DE 10 2011 010 516.6 filed Feb. 8, 2011, the entire contents of which are incorporated herein by reference.

FIELD OF THE INVENTION

The present invention pertains to a method in which a continuously fed material web is strengthened in a strengthening zone, especially a needling zone, and in which the strengthened material web is drawn by a drawing apparatus out of the strengthening zone and pertains to a device including a strengthening zone for strengthening a continuously fed material web and with a drawing apparatus for drawing the strengthened material web out of the strengthening zone.

BACKGROUND OF THE INVENTION

It is known from practice that material webs, especially those consisting of fibers, are needled for strengthening and for producing material structures in a process step. The material web is guided for this continuously into a needling zone, in which oscillatingly driven needles of a needle bar penetrate the material web. The material web is drawn out of the needling zone by a drawing apparatus, e.g., by a plurality of drawing rollers. A drawing speed set by the drawing apparatus now becomes established on the material web. Due to the needles penetrating into and being removed from the material web, it is not possible to carry out the passage of the material at the drawing speed determined by the drawing apparatus. The drawing apparatus therefore generates more or less pronounced drawing forces, which affect the structure of the material web, depending on the motion of the needles.

To keep this effect as minimal as possible, a method and a device for a continuously fed material web is known from U.S. Pat. No. 5,909,883, in which the drawing rollers of a drawing apparatus are driven at a modulated angular velocity, so that a lower drawing speed prevails during a phase during which the needles engage the material web. The insertion cycle and the modulation are coordinated with one another for this, so that the interaction between needling and the drawing apparatus can be reduced.

However, the prior-art method and the prior-art device have basically the drawback that, on the other hand, higher production speeds are not feasible and, on the other hand, the drawing speed of the material web has insufficient constancy for subsequent process steps.

To make it possible to reach higher process speeds, methods and devices are used in the state of the art for needling a material web in which the motion of the needles generate a superimposed horizontal feed on the material web. Such a method as well as such a device are known, for example, from WO 2008/51961 A1. The bar carrier is driven here via a vertical drive and at the same time via a horizontal drive such that the needles are guided on an elliptical guide path, which generates a horizontal stroke and on the material web during each insertion cycle. The size of the horizontal stroke can be set by setting the guide path of the needles. Thus, it is possible to generate a material throughput with a material speed that leads to reduced drawing of the material by the drawing apparatus relative to the drawing speed by setting a correspondingly high insertion frequency and a large horizontal stroke. However, it was found as the production speeds were increased that even small changes in the setting of the horizontal stroke have led to superproportional changes in the drawing of the material by the drawing apparatus. In addition, the initial settings of the horizontal stroke can be preset only on the basis of empirical values, which make a subsequent optimization of the horizontal stroke inevitable. Adjustments of the machine settings by the operators are therefore often necessary.

Furthermore, it is known from DE 103 46 473 A1 that the passage of the material can be controlled as a function of the pattern to produce a pattern in a material web. An electronic camera, which observes the material web and is coupled with a control means for controlling a drive for moving the needles, is provided for this in an intake zone. Zones with and without needling can thus be produced.

SUMMARY OF THE INVENTION

An object of the present invention is to provide an improved strengthening technique.

This object is accomplished by a method and a device according to the invention. The strengthening technique according to the invention, preferably needling technique, has the advantage that the quality of the strengthening process and of the strengthened product formed thereby are improved. The strengthening process and the strengthened product, especially the product properties obtained, can be detected and monitored. The strengthening process can be adjusted, if necessary, in case of deviations. In particular, feeds or needling patterns of the material web can be set and checked specifically.

In addition, the present invention makes possible an improved and especially partly or fully automated set-up and start-up of a strengthening device, especially of a needling machine. Switching off can be improved as well. Quality defects and rejects can be reduced or avoided in all these cases.

In particular, one or more parameters, which represent an indicator for a product property, e.g., the quality of the structure produced in the material web, or a property of the process, can be detected on the running material web. This advantageously happens immediately after the strengthening zone, especially after the needling zone.

The parameter or parameters may be of various types. One parameter may be, e.g., the speed of the material web. Another may pertain to volume or surface properties of the material web, e.g., roughness, pattern, fiber structure, density or the like.

As an alternative or in addition to the strengthening device, one or more other devices or processes arranged upstream and/or downstream in the flow of material in a plant can also be influenced, especially controlled or regulated with the parameter or parameters.

A method according to the present invention and a device according to the present invention are characterized especially in that a parameter of the material web is detected, which determines the actual state of the material web immediately after strengthening, especially needling, and is suitable for use as an indicator for determining a drawing of the material by the drawing apparatus. According to a method according to the present invention, a material speed of the needled material web in a guiding zone arranged downstream of the needling zone before the drawing apparatus is detected. The device according to the present invention has a measuring apparatus for this for detecting a material speed of the material web within a guiding zone located upstream of the drawing apparatus between the needle bar and the drawing apparatus. It is possible due to a method according to the present invention and a device according to the present invention to adapt the horizontal stroke and hence the passage of the material during the needling of the material web immediately to a predetermined drawing speed, so that the most uniform possible motion of the material web will take place. The motion of the needles can thus be adapted to the particular material passage speed such that a difference between the measured actual material speed and a set drawing speed is as low as possible. Abrupt accelerations of the motions of the material, which lead to higher drawing values, are thus avoided.

An advantageous variant of the method according to the present invention, in which the speed of the material web is determined by a contactless measurement of a length of material per unit of time, is characterized in that no contact with the material web is necessary to detect the speed of the material web. Moreover, additional machine parameters, for example, a material feed per insertion cycle, can be determined. In addition, the total lengths of material web produced in a process can be determined.

A device according to the present invention is improved for this such that the measuring apparatus has a sensor means, which contains optical means, especially a transmitter for generating a light signal and a receiver for detecting reflected light signal for scanning the material web. Extremely precise measurements can thus be carried out, for example, according to a laser Doppler method. Such sensors are suitable for measuring material webs with different structures and colors.

It was found that measured signals are possible in different directions of motion during the measurement of the material webs, so that the speed of the material is determined in the direction in which the material web is drawn and/or at right angles to the direction in which the material web is drawn in an advantageous variant of the method according to the present invention. It is thus known that a so-called shrinkage of the material occurs during needling, which leads to a change in the width of the material web. Such effects can advantageously likewise be detected, because the shrinkage of the material substantially affects the quality of the needle pattern in the material web.

Provisions are made according another advantageous variant of a method according to the present invention for an actual value of the material speed to be compared with at least one stored limit value of the material speed. Such monitoring is advantageous especially when a horizontal stroke optimized for the process shall be set during needling. Thus, when needling with a horizontal feed, the horizontal stroke is possibly selected such that the most uniform motion of the material web will prevail, so that the material speed is adapted to the drawing speed. For example, a lower limit value and an upper limit value, which are continually compared with a determined actual value of the material speed, can thus be stored. The machine settings can thus be monitored for needling the material web and corrected if a limit value is exceeded.

To make it possible to make such comparisons, the measuring apparatus is connected according to an advantageous variant of the device according to the present invention to an analyzing unit, by which a plurality of measured values can be stored and/or converted and/or a plurality of data can be calculated and/or compared.

A variant of the method according to the present invention, in which a control signal is generated immediately after a limit value of the material speed is exceeded, is especially advantageous for making it possible to change the machine parameters immediately after exceeding of a limit value is detected.

The control signal can be sent in automatic machines directly to a machine control means, by which the horizontal feed and hence the motion of the needles in the direction in which the material web is moving during the insertion of the needle can be changed.

To achieve an adaptation of the horizontal feed, the guide path of the needles is changed to increase or reduce a horizontal stroke at the material web.

The variant of the device according to the present invention, in which a control module for generating a control signal is associated with the measuring apparatus, is preferably used for this purpose.

To change the machine setting automatically, the measuring apparatus is coupled with a machine control means, by which at least one drive of the needle bar can be controlled.

In case the process is determined by non-automatic procedures, the variant of a method according to the present invention is preferably used, in which the control signal activates a signal transmitter, which is monitored by a human operator. The fact that a limit value of the speed of the material web is exceeded can thus be indicated by optical or acoustic signals, so that a human operator can perform the necessary steps to change the machine parameters.

In case the process is operated essentially via an operating monitor, the method variant in which the control signal generates a data display on an operator monitor, is provided.

The variant of the device according to the present invention in which the measuring apparatus is coupled with an operating monitor for visualizing data or signals is especially suitable for this.

Since a plurality of needling zones, which needling of the material web takes place, are often provided one after another during the needling of a material web, the method according to the present invention can also be used in the variant in which the speed of the material web is detected in the guiding zone between adjacent needling zones.

The device according to the present invention is designed for this such that a plurality of needle bars are arranged at spaced locations one after another and the measuring apparatus is arranged between the needle bars.

The placement of the sensor means depends essentially on the nature of the environment and the guiding of the material web. However, it is possible, in principle, that the sensor means is arranged according to an advantageous variant of the device according to the present invention at an upper stripping plate or at a lower bed plate, which plates are associated with the needle bar. Additional uncoupling means, for example, a separate frame, may also be provided in case of measuring apparatuses susceptible to vibrations.

The method according to the present invention, as well as the device according to the present invention, are thus especially suitable for making possible optimized setting of the machine parameters especially in needling machines with horizontal feed. Changes in parameters can thus be detected and evaluated immediately by the continuous monitoring of the speed of the needled material web. The method according to the present invention, and the device according to the present invention, are therefore especially suitable for producing uniform product qualities on the material web.

The present invention is schematically shown in the drawings as an example. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
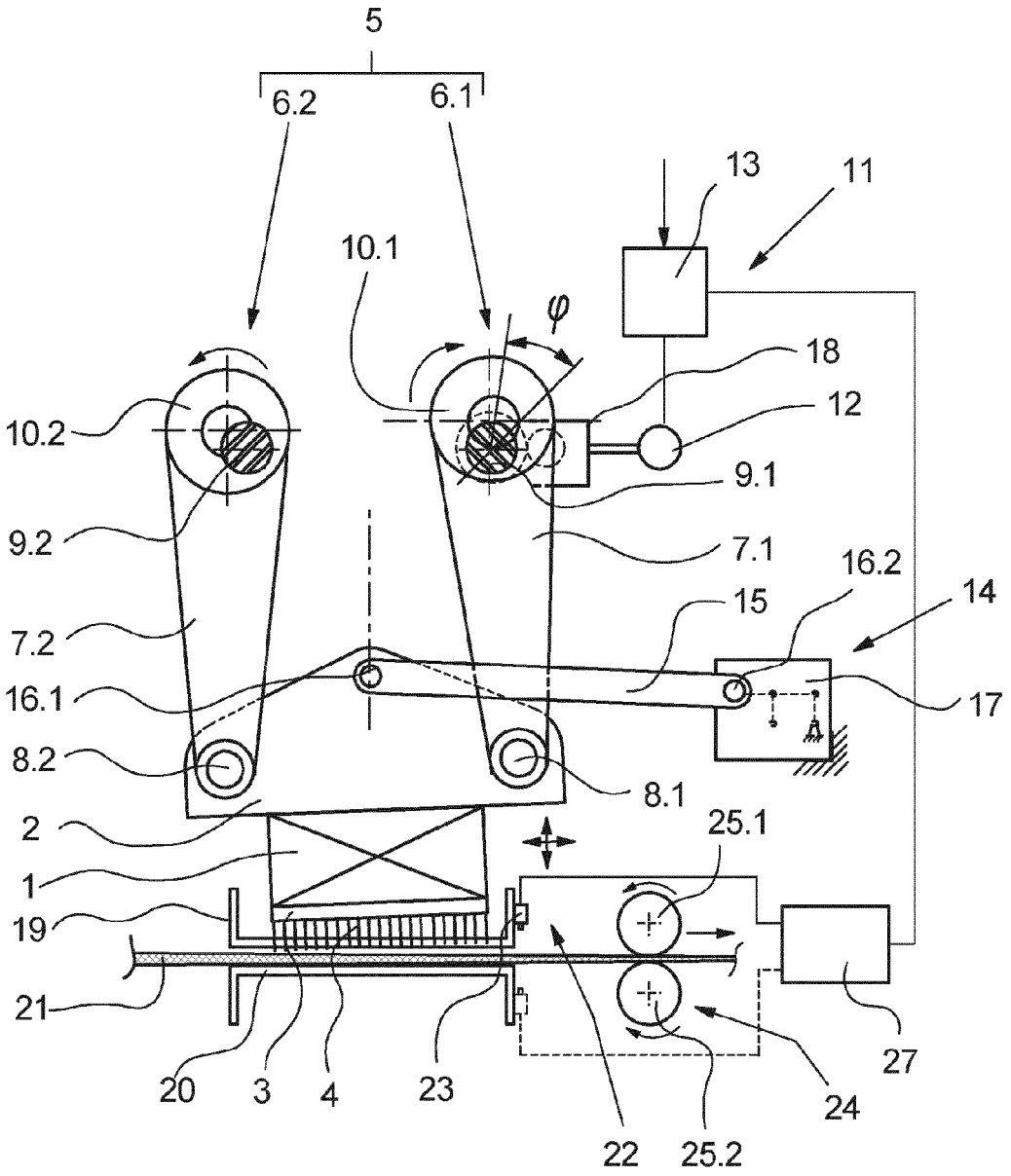
FIG. 1 is a schematic view of a first exemplary embodiment of the device according to the present invention.

Referring to the drawings in particular, the present invention pertains to a device and a method for strengthening, especially needling, a material web 21. The strengthening device is designed as a needling machine in the exemplary embodiments being shown.

The material web 21 comprises, e.g., a single-layer or multilayer nonwoven made of fibers, which is formed by an upstream crosslayer or nonwoven laying device (not shown) from a single-layer or multilayer formed fabric and is fed to the strengthening device. A formed fabric-producing unit, e.g., a carding machine, may be arranged upstream of the crosslayer or nonwoven laying device. The machines may be part of a plant, especially a nonwoven production plant.

The first exemplary embodiment of the device according to the present invention shown in FIG. 1 shows a strengthening device in the form of a needling machine with a strengthening or needling zone with a bar carrier 2 arranged there, which holds a needle bar 1 on its underside. Needle bar 1 carries on its underside a needle board 3 with a plurality of needles 4. A bed plate 20 and a stripping plate 19 are associated with the needle board 3 with the needles 4, and a material web 21 is guided between the bed plate 20 and the stripping plate 19. The direction of motion of the material web 21 is indicated by an arrow here.

A drawing apparatus 24, which is formed by two cooperating drawing rollers 25.1 and 25.2 in this exemplary embodiment, is associated with the needle bar 1 on an outlet side. The drawing rollers 25.1 and 25.2 are driven at a circumferential speed such that the material web 11 is guided out of a needling zone and is fed to a subsequent process at a drawing speed. The needling zone is identical here to the area in which the needles 4 of the needle bar 1 treat the material web 21.

The strengthening device, especially the needling device being shown, may have a draw-in or feed means (not shown) with driven rollers or the like in front of the strengthening or needling zone. The drawing apparatus 24 preferably runs faster than the draw-in means in order to exert a pulling force on the material web (21).

The drive of the needle bar 1 may have any desired design. It is formed in this exemplary embodiment by a crank drive mechanism 5, which has two crank drives 6.1 and 6.2 arranged in parallel next to each other. The crank drives 6.1 and 6.2 contain two crankshafts 9.1 and 9.2, which are arranged in parallel next to each other and are arranged above the bar carrier 2. The crankshafts 9.1 and 9.2 have each at least one cam section for receiving one or more connecting rods. The two connecting rods 7.1 and 7.2 arranged on the bar carrier 2, which are held with their connecting rod heads 10.1 and 10.2 on the crankshafts 9.1 and 9.2, are shown in FIG. 1. The connecting rods 7.1 and 7.2 are connected to the bar carrier 2 with their opposite ends by two connecting rod swivel joints 8.1 and 8.2. Crankshaft 9.1 forms the crank drive 6.1 with the connecting rod 7.1 and crankshaft 9.2 forms the crank drive 6.2 with the connecting rod 7.2 in order to cause the bar carrier 2 and hence the needle bar 1 to perform an oscillating motion.

A phase adjustment means 11 is associated with the crankshaft 9.1. Phase adjustment means 11 has an adjusting mechanism 18 and an actuating adjusting actuator 12 cooperating with the adjusting mechanism 18. Adjusting mechanism 18 is coupled with crankshaft 9.1 for setting a phase angle $\phi$. A control means 13, which is connected to the adjusting actuator 12, is provided for adjustment and activation. Adjusting actuator 12 can be activated via the control means 13 in order to rotate crankshaft 9.1 in its bearing. The phase position between the two crankshafts 9.1 and 9.2 can thus be adjusted. Besides a purely vertical up and down motion of the needle bar 1, a superimposed pivoting or horizontal motion can be performed as a result on the bar carrier 2.

Thus, if the crank shafts 9.1 and 9.2 have the same phase and a synchronous run, an approximately vertical up and down motion is performed. An oscillating oblique position, which generates a horizontal feed on the material web 21 during progressing motion, is initiated on the bar carrier 2 in case of a phase shift with the angle $\phi$ between the crankshafts 9.1 and 9.2 via the connecting rods 7.1 and 7.2. The needles now move along a closed elliptical curved path with a horizontal motion and stroke component. The value of the phase adjustment between the crankshaft[s] 9.1 and 9.2 determines the length of the horizontal stroke. The length of the horizontal stroke can be set in an infinitely variable manner by means of the phase angle $\phi$. Phase angle $\phi$ is set here by the phase adjustment means 11 in an angle range from 0° to 30° depending on the desired length of stroke.

A guiding means 14, which is formed in this exemplary embodiment by a guide arm 15, which is connected to the bar carrier 2 via a first swivel joint 16.1 and to a coupling kinematic mechanism 17 via a second swivel joint 16.2, is provided for guiding the motion of the bar carrier 2.

A measuring apparatus 22 for detecting a parameter, e.g., a material speed, is arranged at the material web 21 in order to monitor especially the passage of the material web 21. Measuring apparatus 22 is formed in this exemplary embodiment by a contactless sensor means 23, which is held at a spaced location from the material web 21. Sensor means 23 has optical means, not shown here, for scanning the material web, which are formed especially by a transmitter for generating a light signal and a receiver for detecting reflected light signals. It would thus be possible to use as the transmitter a laser diode or a laser, which diode or laser generates a bundled light signal and directs same onto the surface of the material web 21. Physical parameters, for example, a length or a speed of the material web, can thus be determined from the transmitted and reflected light signals. Thus, the sensor means could generate, for example, measured signals, which are converted into a material speed according to the laser Doppler method.

The measuring apparatus 22 is coupled in the exemplary embodiment shown in FIG. 1 with an analyzing unit 27, which is connected to the machine control means 13. The actual values of a speed of the material web 21 detected via the measuring apparatus 22 can thus be analyzed and used to set machine parameters.

The exemplary embodiment shown in FIG. 1 shows an operating state in which the crankshafts 9.1 and 9.2 are driven synchronously in opposite directions. Crankshaft 9.1 has a phase angle $\phi \neq 0$ now, so that a superimposed pivoting and horizontal motion is initiated on the bar carrier 2 besides the purely vertical up and down motion. The needles 4 on the underside of the needle carrier 1 are thus guided oscillatingly on a closed elliptical guide path, so that a horizontal needle feed is generated at the material web 21 during an insertion cycle. The horizontal motion of the needles 4 can be adapted to the drawing speed and especially synchronized. An essentially uniform speed of the material web 21 can thus be generated, so that drawing of the material by the drawing apparatus 24 is essentially avoided. However, it is also possible, on the other hand, to influence and set a needling pattern by changing the shape of the elliptical guide path.

To obtain the most uniform speed of the material web 21 possible in the guiding zone following the needling zone, it is useful to coordinate the setting of the length and speed of the horizontal stroke at the needle bar 1 with the production speed of the material web 21. A phase angle is set for this at first via the phase adjustment means 11, so that a needling process can be started. The speed of the material web 21 is now detected via the sensor means 23 within the guiding zone, which extends between the needle bar 1 and the drawing apparatus 24. An actual value of the material speed can now be compared within the analyzing unit 27 with a stored range of tolerance, which has at least one or even two limit values for the material speed, which [limit value or limit values] requires/require resetting of the machine parameters. Thus, if an unacceptable deviation of the speed of the material web 21 is determined, a control signal can be generated, which is sent to the machine control means 13 via analyzing unit 27. For example, a correction of the set phase angle $\phi$ on the crankshaft 9.1 could then be performed within the machine control means 13 in order to reduce or increase the guide path of the needles 4 and hence the horizontal stroke of the needle bar 1. As an alternative or in addition, it is equally possible to change the speed with which the needles 4 are guided and hence the insertion frequency of the needle bar. A relatively uniform speed of the material web 21 can thus be generated. The drive of the needle bar 1 can thus be set to the particular production speed or the drawing speed of the drawing apparatus 24.

Figure 2:
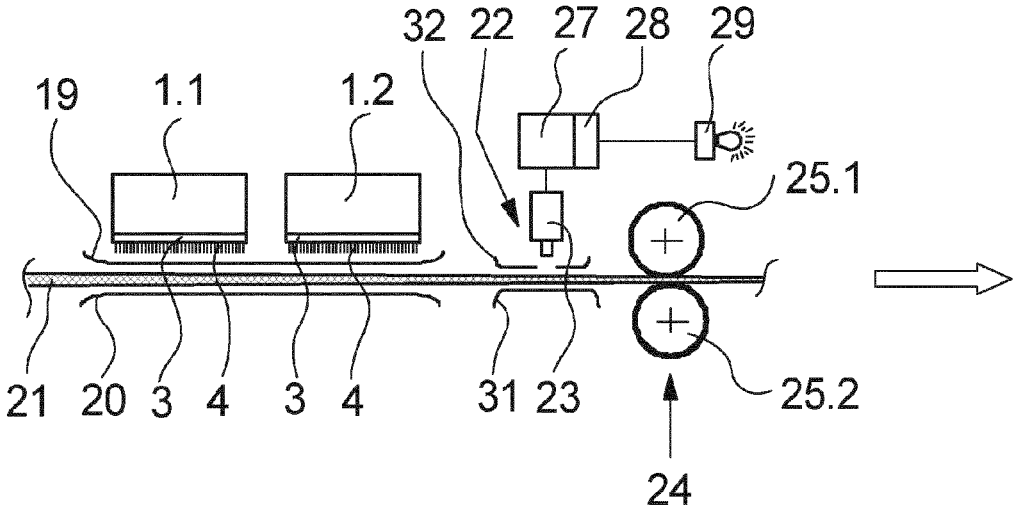
FIG. 2 is a schematic view of another exemplary embodiment of the device according to the present invention.

It is also possible in semi-automatic machines that the analysis of the measured signals of the measuring apparatus 22 leads immediately to a control signal, which is displayed as an acoustic or visual signal by means of a signal transmitter. FIG. 2 schematically shows an arrangement of a device according to the present invention, as it could be used, for example, in a semi-automatic machine. The device is indicated in FIG. 2 only schematically by two needle bars 1.1 and 1.2, which carry on their undersides a needle board 3 each with a plurality of needles 4. Each of the needle bars 1.1 and 1.2 consequently forms a needling zone, in which a material web 21 is needled. The direction of material flow is indicated in FIG. 2 by an arrow, with the material web 21 being drawn off from the two needling zones by the drawing apparatus 24. Material web 21 is guided in the needling zones between a stripping plate 19 and a bed plate 20, which are associated with the two needle bars 1.1 and 1.2. A measuring station with the measuring apparatus 22 is arranged in a guiding zone, which follows the needling zones and extends between the last needle bar 1.2 and the drawing apparatus 24. The measuring station has a lower guide plate 31 and an upper measuring plate 32 for this. The material web 21 is guided between the lower guide plate 31 and the upper measuring plate 32. The sensor means 23, which has a transmitter and a receiver for the contactless scanning of the material web 21, is associated with the upper measuring plate 32. Such sensor means 23 are known in the state of the art, so that no further explanation will be given here.

Measuring apparatus 22 is connected to an analyzing unit 27 and a control module 28. Control module 28 is coupled via a signal line with a signal transmitter 29. Signal transmitter 29 has a lighting means in this exemplary embodiment, by which a visual signal can be generated.

The speed of the material web 21 can be detected continuously by means of the sensor means 23 in the exemplary embodiment shown in FIG. 2. The measured signals of the sensor means 23 are converted within the analyzing unit 27 into an actual value of the speed of the material web 21 and compared with a stored limit value or with a stored range of tolerance with an upper limit value and a lower limit value. If it is determined that a limit value is exceeded, a signal is generated via control module 28 and sent to the signal transmitter 29 for activating the lighting means. A human operator will recognize on the basis of the light signal of the signal transmitter 29 that a limit value of the material speed is overshot or undershot, which possibly requires a change of the machine parameters.

In case the speed of the material web 21 is compared with a lower limit value and an upper limit value, the signal transmitter could have a plurality of lighting means with different color settings. The human operator can thus immediately recognize whether an excessive high speed or an excessively low speed of the material web 21 prevails within the guiding zone.

The material web 26 is needled by two needle bars 1.1 and 1.2 arranged one after another in the exemplary embodiment shown in FIG. 2. To make it possible to coordinate the drives of the two needle bars 1.1 and 1.2 with one another, it is possible to arrange the measuring apparatus 22 in a guiding zone that extends between the needling zones of the two needle bars 1.1 and 1.2.

Figure 3:
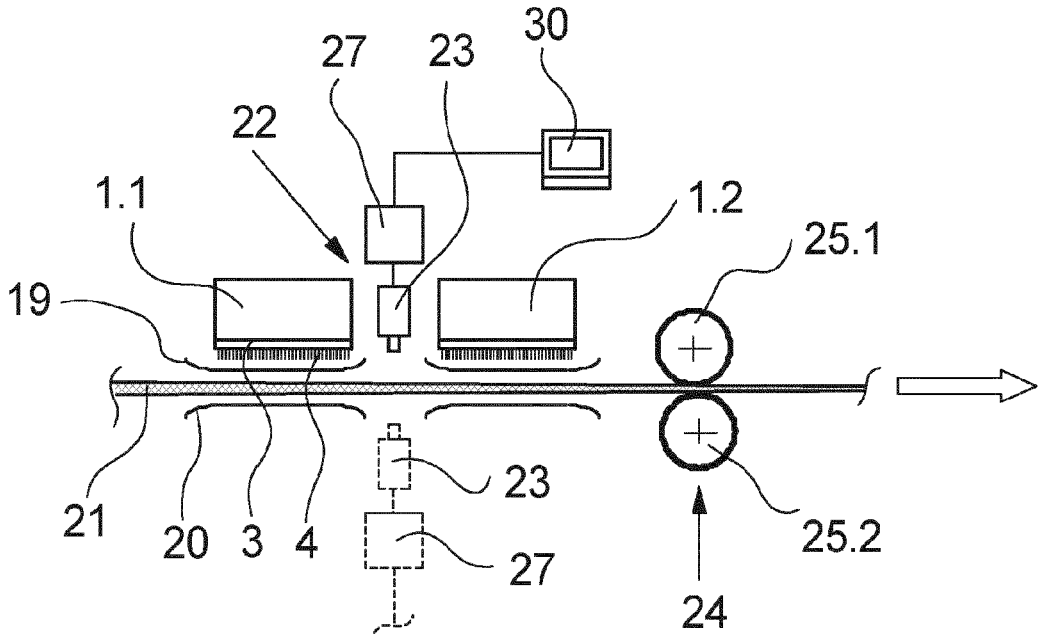
FIG. 3 is a schematic view of another exemplary embodiment of the device according to the present invention.

FIG. 3 schematically shows an arrangement of the device according to the present invention, in which the measuring apparatus 22 is arranged between the needle bars 1.1 and 1.2. The stripping plate 19 associated with the needle bars 1.1 and 1.2 has a multipart design in order to make possible the contactless scanning of the material web 21 by the sensor means 23 between the needling zones.

It should be mentioned here that the measuring apparatus 22 could also be arranged opposite the needle bars 1.1 and 1.2, so that the bed plate 20 is to have a multipart design in order to make possible the scanning of the material web 21 from the underside by the sensor means 23. This arrangement is indicated by broken lines in FIG. 3.

The measuring apparatus 22 is connected to an operating monitor 30 via the analyzing unit 27 in the exemplary embodiment shown in FIG. 3. The speed curves of the measured material speed can thus be displayed immediately on the operating monitor 30. A human operator could thus immediately recognize the result of changes in the setting of the machine parameters in the curve of the actual values of the speed of the material web 21.

The material web is driven after needling by the two driven needle bars 1.1 and 1.2 by the drawing apparatus 24 at an essentially constant drawing speed in the exemplary embodiment shown in FIG. 3. The direction of material flow is likewise indicated by an arrow here. The drawing apparatus 24 is driven, as in the aforementioned exemplary embodiment, by two drawing rollers 25.1 and 25.2.

It should be expressly mentioned here that the drive of the drawing rollers 25.1 and 25.2 can likewise be controlled, so that a control device of drawing apparatus 24 can likewise be coupled with the machine control means 13, so that the drawing speed brought about by the drawing rollers 25.1 and 25.2 can also be changed to set an optimized speed of passage of the material web 21.

Measuring apparatuses with contactless sensor means, which makes [sic—Tr.Ed.] possible the scanning of the material web by means of optical means, are shown in the exemplary embodiments of the device according to the present invention for carrying out the method according to the present invention, which exemplary embodiments are shown in FIGS. 1 through 3. However, the method according to the present invention is not limited, in principle, to the material web 21 being scanned by a contactless sensor means after needling. Measuring apparatuses are also possible in which the speed of the material web is measured via a contact with a measuring wheel. For example, a freely rotatable measuring wheel, whose speed of rotation is detected and whose circumference is kept in contact with the material web, can be arranged on an underside or a top side of the material web.

Optical sensor means, which operate according to the laser Doppler principle, have proved to be especially advantageous for the contactless measurement of the material speed. Two laser beams are generated here by means of a transmitter, and these laser beams generate a stripe pattern on the surface of the material web, the stripe pattern leading to reflections, which are received by a receiver. The necessary measured data, for example, a path length or a speed of the material web, are calculated from the reflected light signals by means of a digitizing unit and a microprocessor.

It should, however, be expressly stated here that a contactless measurement of a length and/or speed of the material web would, of course, also be able to be carried out with other optical measurement methods, for example, according to the spatial frequency filter method, which are not mentioned here.

Figure 4:
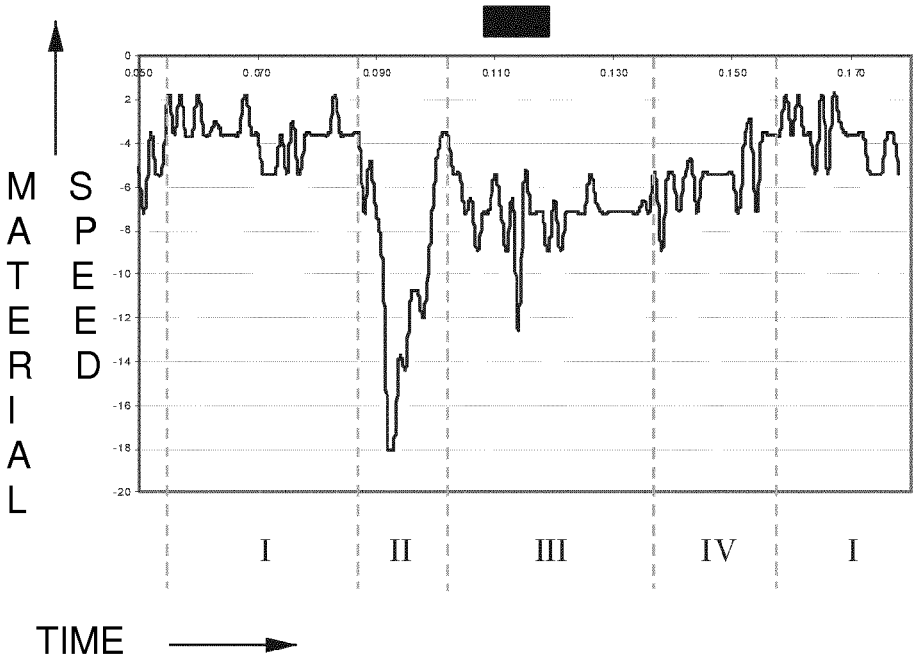
FIG. 4 is a schematic curve of the material speed within an insertion cycle without horizontal feed.

A material web speed curve measured according to the laser Doppler method in a conventional needling process without a horizontal feed of the material web is schematically shown in FIG. 4. A needle insertion cycle relative to the material speed can be divided into four zones here. In a first zone, which is designated by I, the needles are inserted into the material web. The material is held during this phase and is stretched by a stretching of the material occurring between the drawing apparatus and the needle bars.

The needles are removed from the inserted position in phase II, and shrinkage of the material is detected. This leads to high speeds due to slipping of the material in the material web.

Free motion of the material, which becomes established as a speed of passage adapted to the drawing speed in phase IV, takes place in phase III.

The needles are then inserted again, so that the cycle begins anew.

Figure 5:
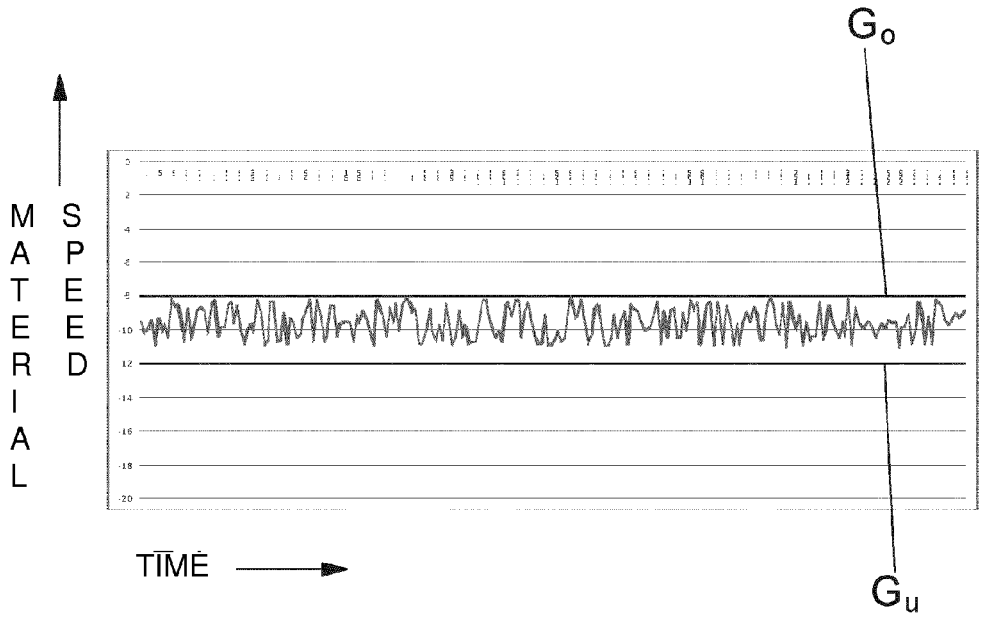
FIG. 5 is a schematic curve of the material speed with optimized horizontal feed.

Such actual values of the speed of the material web are used in the method according to the present invention and in the device according to the present invention to maintain the most uniform motion of the material possible within the entire process. FIG. 5 shows, for example, a speed curve of a uniform motion of a material web. The actual values of the material speed are between an upper limit value GO and a lower limit value GU. During the process and especially at the beginning of the process, it is thus possible to find at first machine settings at which the speed of the material web is maintained within the present limit values.

The method according to the present invention and the device according to the present invention are thus especially suitable for carrying out needling processes with adjustable horizontal feed during which the needles are guided on a circular guide path, which generates a feed of the material web during the insertion cycle. The horizontal strokes set per insertion cycle can thus also be determined, for example, by a distance measurement by the method according to the present invention and used to optimize the process.

However, it was also found during measurements that transverse motions also occur within the material web due to the change in the material structure. These transverse motions, which are also called so-called shrinkage of the material, can be directly detected by such optical sensor means and sent to a visualizing unit. Since the shrinkage of the material substantially affects the quality of the needle pattern, further optimizations can thus be observed during the setting of the machine parameters.

It should be expressly mentioned here that the method according to the present invention and the device according to the present invention are not limited to needling machines whose needle bars are driven with a horizontal stroke. It is also possible, in principle, to optimize in this manner needling processes in which the needle bar or needle bars are driven with a purely vertical motion.

In addition, the adjusting mechanism for setting the horizontal stroke, which is shown in FIG. 1, is only exemplary, The present invention can be combined, in principle, with any automatic or manual adjusting mechanism of known needling machines, e.g., of a needling machine according to EP 0 892 102 A, which has separate drives for the vertical feed and the horizontal feed of the needles.

Moreover, further variants of the exemplary embodiments shown are possible. The strengthening means and the strengthening method may be modified, with the strengthening being performed, e.g., by thermal or chemical methods or by a fluid jet method or according to the Malivlies or Malimo method or in another suitable manner and with another strengthening zone being present instead of the needling zone. The measurement apparatus 22 and the sensor means 23 are preferably located now between this strengthening zone and the drawing apparatus 24.

In addition, the measuring apparatus (22) and the sensor means (23) may also be modified. They are preferably located directly at the outlet of the strengthening or needling zone and may be fastened to a machine part located there. As an alternative, they may be arranged in the guiding zone at a spaced location from the strengthening or needling zone. Furthermore, the design and function of the measuring apparatus and sensor means (22, 23) may vary. For example, the surface of the material web (21) can be scanned with a suitable optical sensor system in order to detect its surface quality, especially its homogeneity. It can thus be determined how rough or smooth the surface is or whether the surface has a pattern or whether strengthening or needling patterns produced deliberately are present in the desired form and design. In addition, the density or thickness of the material web (21) can be detected. A fiber orientation or the existence of undesired holes or other defects in the material web (21) can be detected. Finally, the weight per unit area of the material web (21) can also be detected as a parameter. The above-mentioned parameters may be detected as an alternative or in addition to the material web speed mentioned in the exemplary embodiments. Any desired combinations in the type and number of parameters are possible. The design and arrangement of the measuring apparatus (22) may vary corresponding to the parameter selected. It may have, in particular, a plurality of and optionally different sensor means (23), which are arranged concentrated or distributed in the guiding zone.

The one or more parameters mentioned may be sent, as an alternative or in addition to the machine control means (13), to other control means of machines arranged upstream and/or downstream in the flow of the material web and analyzed there in a suitable manner and used for control or regulation purposes or for other purposes.

While specific embodiments of the invention have been shown and described in detail to illustrate the application of the principles of the invention, it will be understood that the invention may be embodied otherwise without departing from such principles.

The invention claimed is:

1. A method for strengthening or needling a continuously fed material web, the method comprising the steps of:

strengthening the material web in a strengthening zone or a needling zone;

drawing the strengthened material web, by a drawing apparatus, out of the strengthening zone; and detecting speed of the material web, as a parameter of the strengthened material web, in a guiding zone arranged downstream of the strengthening zone and upstream of the drawing apparatus, and the speed of the material web is determined by a contactless measurement of a length of material per unit of time.

2. A method in accordance with claim 1, wherein the speed of the material web is determined in the direction in which the material web is drawn off and/or at right angles to the direction in which the material web is drawn off.

3. A method in accordance with claim 1, wherein:

an actual value of the material web speed is compared with at least one stored limit value of the material web speed; and a control signal is generated as a function of the comparison of the actual value of the material web speed with the limit value of the material web speed.

4. A method in accordance with claim 3, wherein the control signal is sent to a control means of a strengthening means, by which the strengthening process is changed.

5. A method in accordance with claim 3, wherein the control signal is sent to a control means of a needling machine, by which a guide path and/or a guiding speed of needles can be changed.

6. A method in accordance with claim 5, wherein the guide path of the needles is changed to increase or to reduce a horizontal stroke on the material web.

7. A method in accordance with claim 1, wherein the material web is guided through a plurality of strengthening zones or needling zones, for strengthening or needling, and that the speed of the material web is detected in the guiding zone between adjacent strengthening zones or needling zones.

8. A strengthening device comprising:

a strengthening zone for strengthening a continuously fed material web;

a drawing apparatus drawing the strengthened material web out of the strengthening zone; and a measuring apparatus detecting a parameter of the material web, the measuring apparatus being arranged between the strengthening zone and the drawing apparatus within a guiding zone arranged downstream of the strengthening zone and upstream of the drawing apparatus, wherein the measuring apparatus comprises a contactless sensor that detects a speed of the material web by a contactless measurement of a length of material per unit of time.

9. A strengthening device in accordance with claim 8, wherein the strengthening device comprises a needling machine with a needling zone, in which an oscillatingly driven needle bar with a plurality of needles is arranged, wherein the measuring apparatus for detecting a speed of the material web is arranged between the needle bar and the drawing apparatus within the guiding zone arranged upstream of the drawing apparatus.

10. A strengthening device in accordance with claim 8, wherein the measuring apparatus has a sensor means for scanning the material web.

11. A strengthening device in accordance with claim 10, wherein the sensor means has optical means comprising a transmitter, for generating a light signal, and a receiver for receiving reflected light signals.

12. A strengthening device in accordance with claim 8, wherein the measuring apparatus is connected to an analyzing unit, by which a plurality of measured values are stored and/or converted and/or a plurality of data are calculated and/or compared.

13. A strengthening device in accordance with claim 8, wherein the measuring apparatus is connected to a control module for generating a control signal.

14. A strengthening device in accordance with claim 8, wherein the measuring apparatus is coupled with a signal transmitter for generating an optical and/or acoustic signal.

15. A strengthening device in accordance with claim 8, wherein the measuring apparatus is connected to a machine control means, by which a drive of a needle bar is controlled.

16. A strengthening device in accordance with claim 8, wherein the measuring apparatus is coupled with an operating monitor for visualizing data and/or signals.

17. A strengthening device in accordance with claim 8, wherein:

a plurality of strengthening zones or needle bars are arranged at spaced locations one after another; and the measuring apparatus is arranged between the strengthening zones or the needle bars.

18. A strengthening device in accordance with claim 9, wherein the measuring apparatus is arranged at an upper stripping plate associated with the needle bar or at a lower bed plate associated with the needle bar.

* * * * *